US005299335A

United States Patent [19]

Ivester et al.

[11] Patent Number: 5,299,335

[45] Date of Patent: Apr. 5, 1994

[54] FRAGRANCE-RELEASING PILLOW AND THE LIKE

[76] Inventors: Philip K. Ivester, 317 E. 8th St., Rome, Ga. 30161; Edgar L. Watson, 105 Pine Valley Rd., Rome, Ga. 30165-4339

[21] Appl. No.: 110,702

[22] Filed: Aug. 23, 1993

[51] Int. Cl.[5] ..... A47G 9/00; A47C 27/00

[52] U.S. Cl. ..... 5/641; 5/645; 5/448; 5/462; 128/202.18; 239/56; 239/60

[58] Field of Search ..... 5/641, 645, 636, 639, 5/448, 462, 490; 239/56, 60; 119/28.5, 169; 128/202.18

[56] References Cited

U.S. PATENT DOCUMENTS

| | | | |
|---|---|---|---|
| 1,617,822 | 2/1927 | O'Leary | 5/641 |
| 2,688,985 | 9/1972 | Engel | 239/54 |
| 4,228,954 | 10/1980 | Rosenzweig | 239/60 |
| 5,038,431 | 8/1991 | Burgin et al. | 5/641 |
| 5,087,273 | 2/1992 | Ward | 239/60 |

*Primary Examiner*—Alexander Grosz

*Attorney, Agent, or Firm*—Vivian L. Steadman; Harry I. Leon

[57] ABSTRACT

A pillow for increased comfort while sleeping which is stuffed with a fibrous filling in which are embedded capsules impregnated with a volatile substance. The volatile substance may be either a fragrance, a medicinal agent or a sanitizing agent. The capsules are held within the pillow in such a way as to prevent them from migrating through the filling. Devices for preventing such migration include strips of porous fabric with one or more compartments formed therein. The compartments retain individual groups of capsules in spaced apart relationship to each other within the pillow. Alternately, the fibers of the filling are pretreated with a volatile agent which is adsorbed on the fiber surfaces, preventing the agent from migrating within the filling. In pillows with a filling otherwise capable of releasing volatile agent(s) but having a non-breathable, air impermeable ticking of vinyl or the like, small vents are formed in each corner of the ticking to allow such agent(s) to escape. A compartmentalized strip holding capsules impregnated with a volatile substance can also be secured within a pillowcase, generally establishing the position of the capsules relative to any pillow which might be placed within the pillowcase.

4 Claims, 1 Drawing Sheet

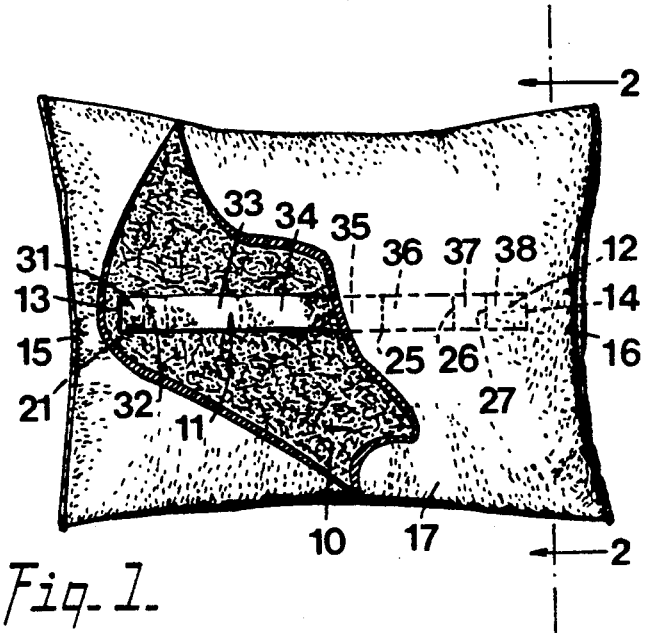
Fig. 1.
Fig. 2.
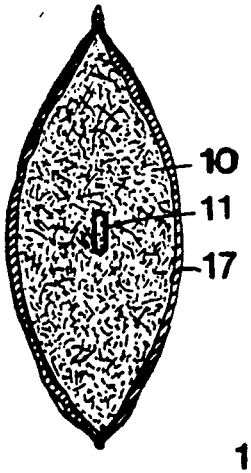
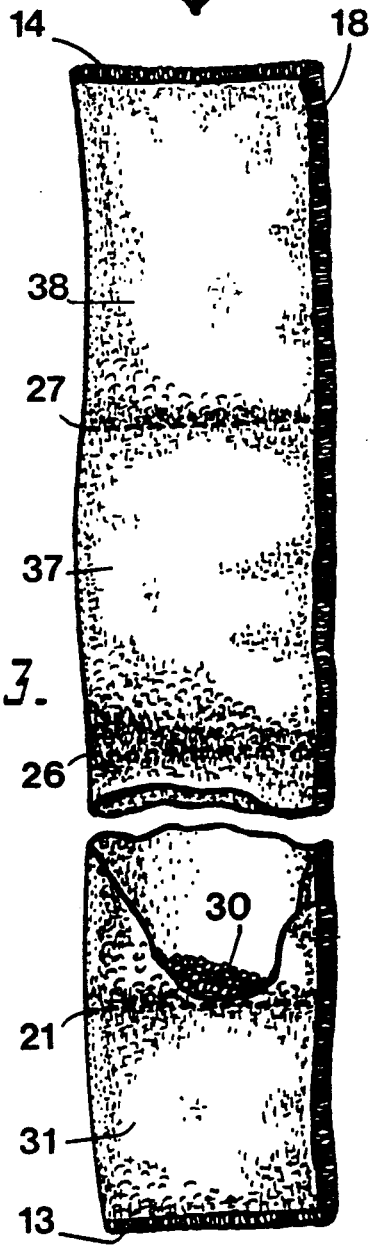
Fig. 3.
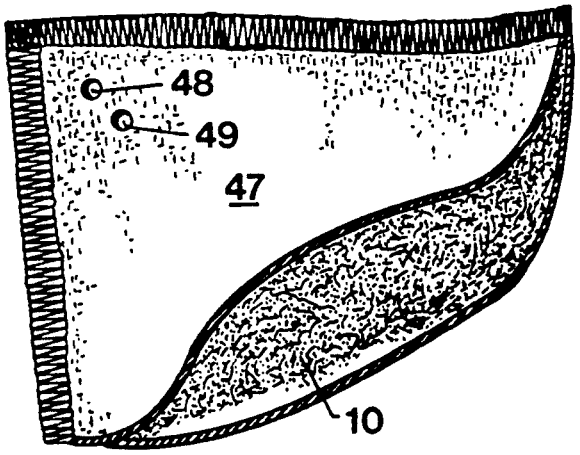
Fig. 5.
Fig. 4.
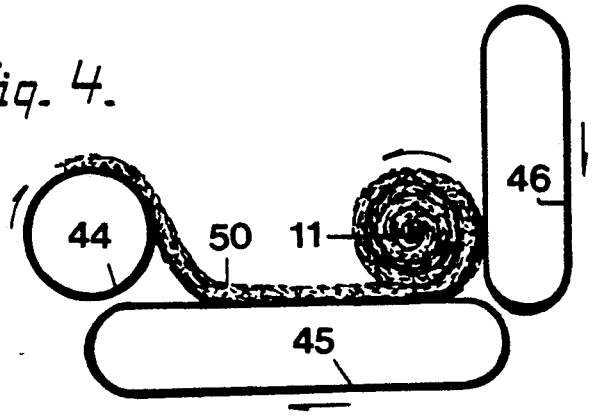

FRAGRANCE-RELEASING PILLOW AND THE LIKE

BACKGROUND OF THE INVENTION

The prior art teaches the manufacture and certain uses of preformed synthetic resin carriers impregnated with volatile matter. As taught by Engel in U.S. Pat. No. 3,688,985, issued on Sep. 5, 1972, such carriers come in several forms: as sheets, webs, film, threads, and variously shaped hollow and/or solidly formed articles including granules. Depending upon the volatile matter impregnating the carrier, it can release a medicinal agent, a fragrance, a flavor, or a sanitizing agent or a combination thereof to the surrounding environment gradually over a considerable period of time.

The prior art further teaches that a preformed synthetic resin carrier impregnated with a volatile medicinal agent should be placed, in use, so that as the agent volatilizes, it can be readily inhaled by a patient for its therapeutic effect. One preferred placement of such a carrier, according to Engel, is under a patient's pillow. Unfortunately, a carrier so placed can accidentally come into direct contact with the patient's body causing possible allergic reactions among chemically sensitive persons.

SUMMARY OF THE INVENTION

The primary object of the present invention is to provide an improved stuffed article, such as a pillow, mattress, furniture cushion or the like, in which capsules impregnated with volatile substance(s) are secured internally within the article so as to prevent the capsules from migrating to location(s) substantially removed from those in which the capsules were placed during initial assembly of the stuffed article.

A further object of the present invention is to provide means for masking odors such as those of smoke, of pets or of urine which are absorbed by pillows, mattresses, furniture cushions and the like. Especially in nursing homes is there need for pillows capable of emitting fragrance to mask the smell of urine. Similarly, pillows with the capacity to mask musty odors are much needed in motels situated in damp locales.

In accordance with the present invention, there is provided an improved stuffed article in which is embedded at least one device having one or more compartments for retaining capsules impregnated with fragrance or the like in a generally fixed position within the stuffed article.

Alternately, there is provided an improved stuffed article having a fibrous filling pretreated with a volatile agent which is adsorbed on the fiber surfaces, preventing the agent from migrating within the filling.

In stuffed articles of angular shape and having a filling otherwise capable of releasing volatile agent(s) but having a non-breathable, air impermeable ticking of vinyl or the like, small vents are formed in the ticking to allow such agent(s) to escape.

BRIEF DESCRIPTION OF THE DRAWINGS

These and other features of this invention will be more readily understood by consideration of the detailed description taken with the accompanying drawings, in which:

FIG. 1 shows an elevation view of a fragmentary section of a stuffed article according to the present invention, the stuffed article having, embedded in its filling, a compartmentalized insert for retaining capsules impregnated with a volatile substance;

FIG. 2 is a cross-section taken along line 2—2 in FIG. 1;

FIG. 3 is a detailed view of fragmentary distal end portions of the insert for the stuffed article according to FIG. 1;

FIG. 4 is a schematic diagram showing the insert in the process of being embedded within the filling prior to its being stuffed inside ticking to form an article according to FIG. 1; and FIG. 5 is a fragmentary section of an alternate embodiment of a stuffed article according to the present invention, the ticking covering the article having vents formed therein to facilitate release of volatile agent(s) from the filling.

DESCRIPTION OF THE PREFERRED EMBODIMENT

Referring to the drawings, there is shown therein a pillow having a filling 10 in which is embedded an insert indicated generally by the numeral 11. As is best seen in FIGS. 1 and 3, the insert 11 comprises a substantially rectangular panel 12 of a breathable fabric which is doubled over on itself and stitched together, along spaced apart, transverse seams, among which are seams 21, 25, 26, 27, to form multiple compartments 31 through 38 for retaining volatile substance-impregnated capsules 30. The capsules 30, once inserted into the compartments 31 through 38, are sealed therein by stitching together opposing longitudinal edges of the panel 12, thereby forming seam 18.

The amount of capsules 30 sealed within each insert 11 varies with the odor characteristics of the volatile substance impregnating the capsules, including the rate of volatilization and expected lifetime of the substance, and the thickness of the filling 11. As a rule, for more pungent odors, less of the volatile substance is utilized.

About 1 gram of capsules 30 of a starch polymer impregnated with a fragrance has been found to be an optimum amount to imbue a room with fragrant odor when this 1 gram of capsules is sealed in, and generally evenly distributed throughout the compartments 31 through 38, of an insert 11 embedded in a conventional, rectangularly-shaped pillow with a 100% polyester filling. Alternately, the pillow in which the insert 11 is embedded can be filled with feathers, down, fibers of cotton, of polyester, of acrylic, or of nylon, polyurethane foam, latex foam, or a combination thereof. Experience has further shown that, under the conditions of use of the insert as described hereinbelow, this 1 gram amount of capsules, at least for certain fragrant starch polymers, emits adequate levels of fragrance for periods in excess of one year, with an estimated lifetime of two years. Among these fragrant starch polymers are those bearing the trademark DURA-SCENT® (Federal Registration No. 1701251), from Fragrance Resources, Keyport, N.J. Alternately, capsules 30 fabricated as disclosed by Engel in U.S. Pat. No. 3,688,985 can be employed.

In preferred embodiments involving a pillow which is substantially rectangular in outline, the insert 11 generally measures about 5 inches shorter than the greatest length of the pillow so that there is typically at least as much filling between the insert 11 and a ticking 17 covering the pillow, in any given direction, as between the insert and the upper or lower surface of the ticking near the center of the pillow. When the insert 11 is used with a substantially rectangular pillow of a standard size which measures generally 19 inches by 25 inches along its greatest periphery in transverse cross-section, for example, the insert 11 preferably measures about 19 inches in length, leaving, between each of the distal ends 13, 14 of the insert 11 and the proximate end seam 15, 16, respectively, of the ticking 17, a distance of 2½ inches (FIG. 1).

Embedding an insert 11 in a filling 10 for use in a conventional, rectangularly-shaped pillow is preferably achieved by placing the insert on an advancing band 50 of fibrous filling material as the band starts to roll off of a garnett machine 44. Preferably, the insert when so placed is disposed centrally, generally parallel to and near the leading edge of the band 50. Alternately, an insert 11 can be placed diagonally with respect to the leading edge; or shorter inserts, otherwise similar to the insert 11 but having proportionally less capsules 30, can be positioned at random on the advancing band 50. In any case, as the band 50 subsequently moves forwardly down a horizontal conveyor belt 45, the band encounters a vertical conveyor belt 46 and is progressively wound about the leading edge and the insert 11 (FIG. 2). The number of times the band 50 is wound thereabout depends upon the type of pillow in which the filling 10 is to be used, upon the physical characteristics, including the density and resiliency, of the fibrous material in the band, and upon whether the fiber is solid or has one or more longitudinally extending holes. When sufficient material has been so wound, the band 50 is torn in two upstream of the conveyor 46; and the filling 10 with embedded insert 11 is removed from the conveyor 45. Afterwards, the filling is first weighed to verify that its weight is correct, the filling for standard, queen-size and king-size pillows typically weighing about 20, 25 and 30 ounces, respectively, per pillow. Then the filling is stuffed into the ticking 17. Alternately, the filling 10 can be fabricated from clusters of blown polyester or the like. In the latter case, the insert 11 is hand-placed in the filling 10, once the filling has been stuffed inside a partially formed enclosure of ticking 17. Finally, the ticking 17 is stitched together as required to form a complete enclosure for the filling 10.

On the other hand, tests of pillows having a filling 10 in which bead-like capsules 30 were randomly placed therein have given unsatisfactory results. Within one week, these randomly-placed capsules 30 largely settled out of the filling to one side of the pillow. In an alternate embodiment in which this settling tendency is overcome without the use of inserts 11, a stuffed article having a fibrous filling pretreated with a volatile agent which is adsorbed on the fiber surfaces of the filling is provided. Suitable methods for pretreating fibrous filling with a volatile agent are taught by Engel in U.S. Pat. No. 3,688,985.

When non-breathable, air impermeable ticking 47 of vinyl or the like is employed to fabricate a stuffed article, as is commonly done with pillows intended for hospital or nursing home use, at least one vent hole 48, 49 must be preformed in each corner of the ticking to allow medicinal or other volatile agent(s), otherwise entrapped with the filling inside the ticking, to escape (FIG. 5). In the case of ticking 47, covering a generally rectangularly shaped pillow, preferably at least one pair of vent holes 48, 49 is provided in each of the four corners of the ticking. During fabrication, the vent holes 48, 49 are preferably predrilled in fabric stacked thirty layers high before the fabric is cut and stitched to form ticking 47 for individual pillows. In the preferred embodiment, each hole 48, 49 measures, by way of example, about 1/16 inch in diameter. Holes with openings of ⅛ inch or larger, on the other hand, have been found to be unsatisfactory because fibers in the filling tend to protrude through them unless they are screened and then one must use a grommet which is not only costly, but presents an annoyingly hard object to pillow users. Alternately, vent holes are punched in the ticking by stitching it together as required to form a complete enclosure for the filling with the use of a double needle, only one needle thereof being threaded and employed to stitch and the other needle being used, simultaneously, to punch a series of fine vent holes spaced apart from the stitching.

While embedding the capsules 30 inside the filling of the stuffed article offers a user the greatest degree of protection from possible allergic reactions resulting from close contact with the capsules, specially designed pillowcases having pockets, hook and loop-type fasteners or like can also be used to secure an insert 11 in a generally fixed position. An insert 11 having attached thereto one face of a Velcro-type fastener or the like can be attached to an intermeshing face of a hook and loop-type fastener secured to an inside surface of a pillowcase. With the pillowcase marked to show which side thereof is intended for bodily contact and which is not, the user has reasonable assurance that his or her body will generally be isolated from the insert 11 and its contents by the full thickness of the pillow filling as long as the proper orientation of the pillowcase is maintained.

It will be understood that the invention is not limited to the embodiments or use of the materials disclosed, but is capable of numerous rearrangements, modifications and material substitutions deemed equivalent to or superior to the above without departing from the scope of the invention.

What is claimed is:

1. An article stuffed with a fibrous filling material, comprising a ticking enclosing and surrounding said fibrous filling, a plurality of capsules impregnated with a volatile substance, and holding means adapted to contain said capsules, said holding means defined by a breathable fabric, said holding means having a plurality of individual compartments, each of said compartments containing a plurality of said capsules, said holding means being located in a generally central region of the article, spaced apart from said ticking, and being surrounded by the fibrous material, whereby upon use of the article, the capsules are retained in the individual compartments of the holding means, in said generally central region of the article.

2. The article of claim 1, wherein the ticking is made from an air impermeable material, and it has at least one vent hole formed therein.

3. The article of claim 1, wherein the breathable fabric of the holding means is doubled and stitched over on itself and stitched along spaced apart transverse seams to thereby define said individual compartments.

4. The article of claim 1, wherein the article is useable as a pillow, mattress, furniture cushion or the like.

* * * * *